US006468034B1

(12) United States Patent
Garrison et al.

(10) Patent No.: US 6,468,034 B1
(45) Date of Patent: Oct. 22, 2002

(54) FLUSH MOUNT ROUND EXHAUST FABRICATED INDUCER HOUSING

(75) Inventors: Bobby D. Garrison, Cassville, MO (US); Steven W. Post, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

(21) Appl. No.: 10/005,229

(22) Filed: Dec. 3, 2001

Related U.S. Application Data

(60) Provisional application No. 60/251,975, filed on Dec. 4, 2000.

(51) Int. Cl.[7] ..... F04D 29/44

(52) U.S. Cl. ..... 415/212.1; 415/200; 415/204; 415/206

(58) Field of Search ..... 415/206, 212.1, 415/203, 204, 207, 182.1, 224, 200; 110/341, 205, 206, 214, 297, 147, 162

(56) References Cited

U.S. PATENT DOCUMENTS

| | | | | |
|---|---|---|---|---|
| 87,625 | A | 3/1869 | Bookwaller | |
| 3,485,443 | A | * 12/1969 | Earhart | 415/200 |
| 4,247,250 | A | 1/1981 | Lipe et al. | |
| D263,839 | S | 4/1982 | Somme | |
| 5,040,943 | A | 8/1991 | Dwyer et al. | |
| 5,074,751 | A | * 12/1991 | Sixsmith | 415/204 |
| 5,112,190 | A | 5/1992 | Kajiwara et al. | |
| 5,133,642 | A | 7/1992 | Kajiwara | |
| 5,310,310 | A | 5/1994 | Nakatsukasa et al. | |
| 5,314,300 | A | * 5/1994 | Gatley et al. | 415/119 |
| 5,358,380 | A | 10/1994 | Arakawa | |
| 5,414,999 | A | 5/1995 | Barnes | |
| 5,551,836 | A | * 9/1996 | Roth et al. | 415/204 |
| 5,820,458 | A | 10/1998 | Lai | |
| 5,864,190 | A | 1/1999 | Bacchiocchi | |
| 5,951,245 | A | 9/1999 | Sullivan | |
| 5,997,246 | A | 12/1999 | Humbad | |
| 6,155,781 | A | 12/2000 | Tsai | |
| D439,648 | S | * 3/2001 | Jones et al. | D23/370 |
| 6,206,633 | B1 | 3/2001 | Nakamura et al. | |
| 6,314,894 | B1 | 11/2001 | Gatley, Jr. | |

* cited by examiner

*Primary Examiner*—Edward K. Look
*Assistant Examiner*—Richard A. Edgar
(74) *Attorney, Agent, or Firm*—Andrus, Sceales, Starke & Sawall, LLP

(57) ABSTRACT

A furnace blower housing that can be flush mounted to a furnace and includes an integrally formed round exhaust outlet. The blower housing is formed from two separate housing members joined to each other. The blower housing includes an impeller cavity that encompasses a rotating impeller that directs the exhaust gases out of a rectangular outlet. An integrally formed transition section extends from the rectangular outlet to a circular exhaust outlet. The transition section is formed by a bottom half integrally formed with the first housing member and a top half integrally formed with the top housing member. The exhaust outlet is offset from the back plate of the blower housing such that the blower housing can be flush mounted to a furnace.

16 Claims, 6 Drawing Sheets

FLUSH MOUNT ROUND EXHAUST FABRICATED INDUCER HOUSING

CROSS-REFERENCE TO RELATED APPLICATION

The present application is based on and claims priority to U.S. Provisional Patent Application Serial No. 60/251,975, filed on Dec. 4, 2000.

BACKGROUND OF THE INVENTION

The present invention is directed to a blower housing. More specifically, the present invention is directed to a blower housing for use as part of a blower assembly used in furnaces to remove combustion gases and can be easily mounted to a furnace collector box for flue exhaust transitions.

The need to heat structures to control the interior temperature has been a requirement for modern housing for a long time. One of the current popular methods used to heat'structures is with a furnace that burns either oil or natural gas. Due to the increasing costs of fossil fuels, the operating efficiency of furnaces has become a greater and greater concern.

One common method of increasing the fuel efficiency of the burner within a furnace has been to utilize a blower to induce a draft through the furnace to draw the heated air and the products of combustion through a heat exchanger and exhaust them through an exhaust pipe. The blower increases the draft such that the heated air and the products of combustion can travel through as tortured a path as possible to increase the amount of heat removed from exhaust gases within the heat exchanger. The increase in the flow of air thereby increases the heat transfer and generating capacity of the burner while simultaneously using less fuel per BTU of heat generated. The addition of a blower motor to a furnace generates a rating of about 80 percent fuel efficiency in a modern furnace. Thus, it is clearly a necessity to introduce a blower to a modern furnace to maintain minimum desired efficiency standards.

Since the introduction of a blower increases the cost of the furnace, it is important to connect the blower assembly to the furnace in the most effective and efficient manner. There are currently two types of furnace blower motor assemblies sold on the market. The first type of blower motor assembly is known as the "round exhaust/non-flush mount blower assembly". The second type of blower motor assembly is known as the "rectangular exhaust/flush mount blower assembly". While both types of blower motor assemblies accomplish the goal of an 80% efficiency standard, each type also has its own significant shortcomings addressed below, which are solved by the present invention.

The first type of blower assembly is the "round exhaust/non-flush mount blower assembly". This type of blower assembly has the advantage of having a round exhaust that is offset from the mounting surface. The round exhaust allows the furnace manufacturer to install the blower onto the furnace without adding an expensive transition piece to allow the customer to hook up their round flue pipe. A significant disadvantage of this blower is that the mounting flange is not flush with the mounting surface that connects with the furnace collector box.

The disadvantage with the mounting flange not being flush with the collector box lies in the steps required to mount the blower to a furnace. Great care must be taken when mounting the blower to the furnace because the mounting screws overhang and cocking of the blower during assembly can cause great damage if the process is not done correctly. If the blower is damaged, repair is expensive and time consuming and there are quality issues involved with the finished product. Therefore, because of the possible damages that can occur with improper mounting, the assembler must take greater care and work at a slower pace while ensuring that the screws are not over-torqued when securing the blower assembly to the furnace.

Other manufacturers have attempted to address this problem through the use of a mounting flange added as a third piece to their round exhaust/non-flush mounted blower assembly. A mounting flange addition provided a solution to the cocking problem but at an increased cost and complexity due to the exact dimensional requirements to mount the blower to the mounting flange and then the furnace.

The second type of blower motor assembly is known as the "rectangular exhaust/flush mount blower assembly". This type of blower assembly has the advantage of flush mounting of the blower, thereby significantly removing the chance. that the blower is not flush during assembly and therefore preventing the damage that occurs when the blower is cocked. Flush mounting allows for a fast and worry-free mounting process without fear of damage and expensive reworking issues. Unfortunately, this type of blower assembly has the disadvantage of having a rectangular exhaust outlet. Therefore, to allow the customer to attach the blower assembly to a round exhaust flue, an expensive rectangular to round transition piece must be used. Typically, this transition device is formed from cast aluminum, which is expensive to manufacture.

An attempt to address this problem involved the use of a transition piece made out of a polymeric material. The polymer transition piece was either injection molded or thermoformed. A polymer transition piece has largely been discarded because of the inherent problems associated with the use of plastics in the harsh operating environment the transition piece must endure. Polymers that are able to withstand the harsh operating environment are very expensive, and even with the use of expensive engineering polymers, there still remain potential problems with polymer durability that has made the use of polymers a less than desirable solution.

The present invention solves the problems associated with the currently available furnace blower motor assemblies with a novel and cost efficient solution. There has been an unrecognized but long felt need in the industry to solve the problems stated above. The present invention solves the above stated problems with an easy to manufacture and assemble solution that has eluded manufacturers for, several years.

Accordingly, it is an object of the present invention to provide a flush mounted round flue exhaust inducer housing formed from a two-piece stamped steel shell. It is another object of the present invention to provide a blower housing that reduces the complexity involved with manufacturing. It is yet another object of the present invention to provide a simple cost effective solution to provide a flush mounted blower assembly with a round exhaust flue with a separate transition device.

SUMMARY OF THE INVENTION

The present invention relates to a blower housing formed from a two-piece construction of stamped steel members joined to each other. The blower housing includes an integrally formed transition section extending from a rectangular throat to a circular exhaust outlet and provides for flush mounting of the blower housing to a furnace. The blower housing includes a first housing member that includes a generally planar back plate. The back plate includes an inlet opening that allows flue gases to enter into the blower housing from the furnace. The first housing member includes an outer edge that terminates with an extended lip portion.

The first housing member defines the first portion of the outlet transition section between the impeller cavity and the circular exhaust outlet. The first housing member includes an attachment flange that extends along the integrally formed transition section.

The blower housing further includes a second housing member that is attachable to the first housing member to form the impeller cavity. The impeller cavity is sized to contain an impeller mounted to a motor shaft that extends through the top mounting portion of the second housing member. As the impeller rotates within the impeller cavity, a flow of exhaust gases is directed into the transition section and finally out of the exhaust outlet. The second housing member includes an outer wall that spaces the first housing member from the second housing member.

The second housing member defines the second half of the transition section and includes a flange that is received on a mating flange and lip of the first housing member.

The two-piece combination of the first housing member and the second housing member combine to create the transition section that extends between a circular exhaust outlet and the rectangular outlet throat of the impeller cavity formed in the blower housing. Thus, as the impeller rotates, exhaust gases pass through the outlet throat of the impeller cavity and enter into the transition section. The transition section is angled away from the back plate of the first housing member such that the exhaust outlet of the transition section permits flush mounting of the blower housing.

During construction, the first housing member and the second housing member can be joined by any one of several attachment methods. Preferably, the first housing member and the second housing member are formed from stamped steel and are joined by crimping the two members to each other. The crimping provides a tight connection that will resist rattling and is less labor intensive, thus reducing the cost to manufacture the blower housing of the present invention.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 5:
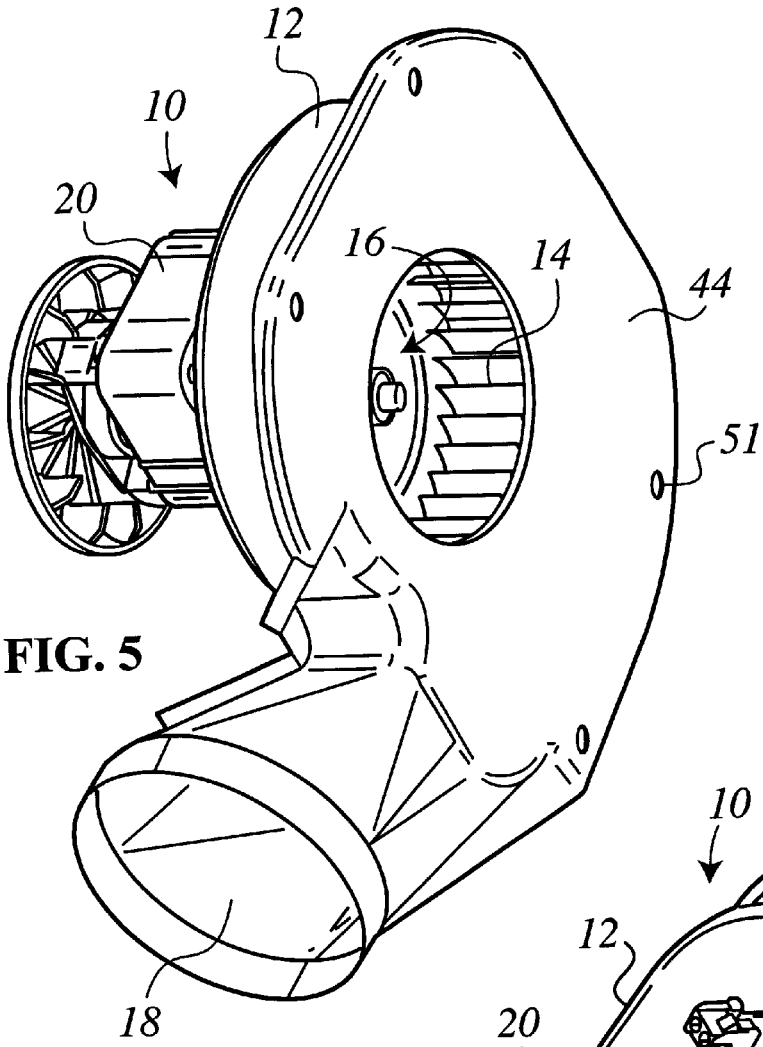
FIG. 5 is a back perspective view illustrating the blower housing of the present invention.
Figure 6:
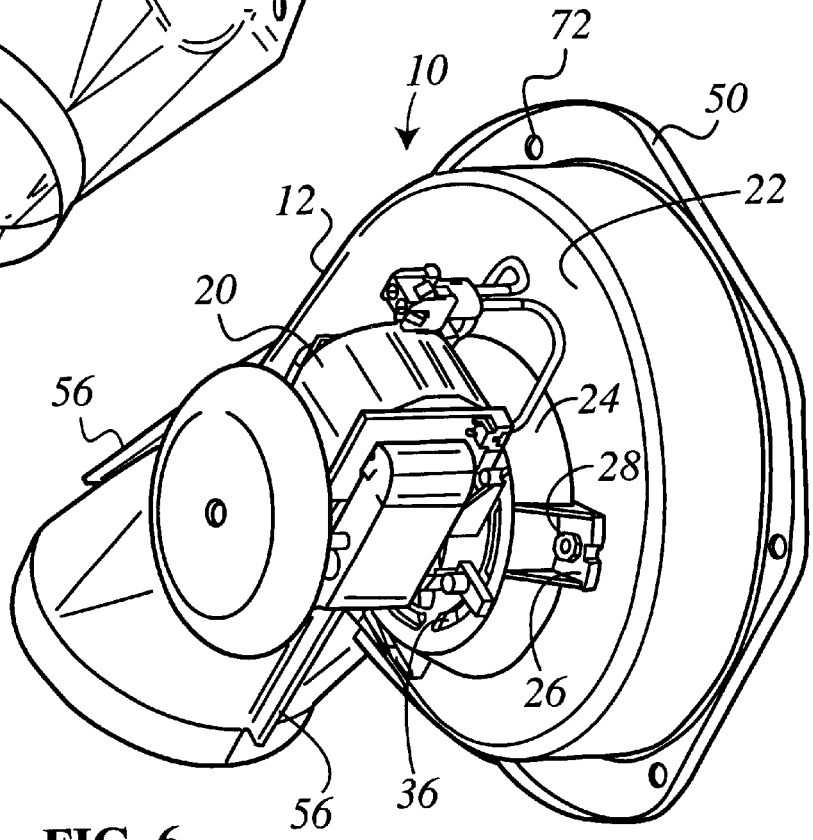
FIG. 6 is a front perspective view illustrating the blower housing and motor assembly of the present invention.

Referring first to FIGS. 5 and 6, thereshown is a blower assembly 10 constructed in accordance with the present invention. The blower assembly 10 generally includes a blower housing 12 that is configured to enclose a rotating impeller 14. The rotating impeller 14 is centered around an inlet opening 16. The inlet opening 16 is positioned to receive flue gases from a furnace and direct the flue gases into contact with the rotating impeller 14, which then directs the gases out of an exhaust outlet 18. As illustrated in FIGS. 5 and 6, the exhaust outlet 18 is circular in shape such that the exhaust outlet 18 is capable of receiving the end users round flue pipe to direct the flue gases away from the furnace.

As best illustrated in FIG. 6, a blower motor assembly 20 is mounted to the top surface 22 of the blower housing 12. Specifically, the motor assembly includes a fan shroud 24 that includes a plurality of attachment feet 26 that each receive a connector 28 to secure the blower motor assembly to the top surface 22 of the blower housing 12.

Figure 4:
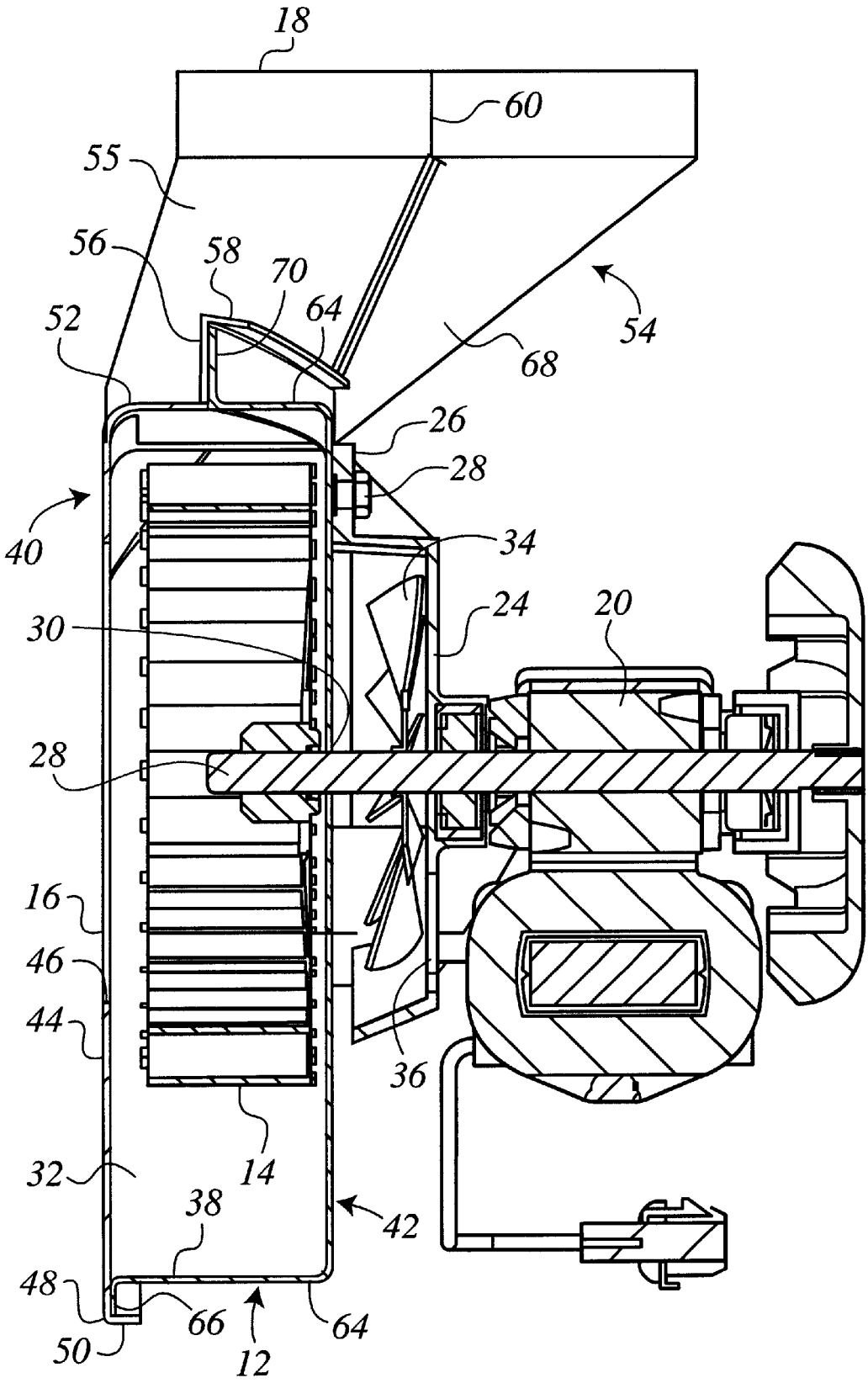
FIG. 4 is a section view taken along line 4–4 of FIG. 3.

Referring now to FIG. 4, the blower motor 20 includes a motor shaft 28 that extends through a shaft opening 30 formed in the blower housing 12 and is connected to the impeller 14. The impeller 14 is enclosed within an impeller cavity 32 formed by the blower housing 12.

A cooling fan 34 is mounted to the rotating motor shaft 28 to direct a flow of cooling air over the motor 20 during operation of the blower assembly. The cooling fan 34 is contained within the fan shroud 24 and directs air through a plurality of vents 36 formed in the top. surface of the fan shroud 24.

As can be seen in FIG. 4, the impeller 14 is centered above the inlet opening 16 such that the impeller 14 draws a flow of air through the inlet opening 16. The flow of air drawn through the inlet opening 16 is directed radially outward against the outer wall 38 of the blower housing 12. The outer wall 38 is scroll shaped such that the flow of air is directed within the impeller cavity 32 toward a rectangular outlet throat, which is connected to the exhaust outlet 18. As discussed previously, the exhaust outlet 18 is circular in shape such that it can be connected easily to a round flue pipe to direct the flue gases away from the blower assembly 10.

The above description generally describes the function and operation of the blower assembly 10 of the present invention. However, the specific configuration of the blower housing 12, including the integrally formed exhaust outlet 18, forms the basis of the present invention.

Figure 7:
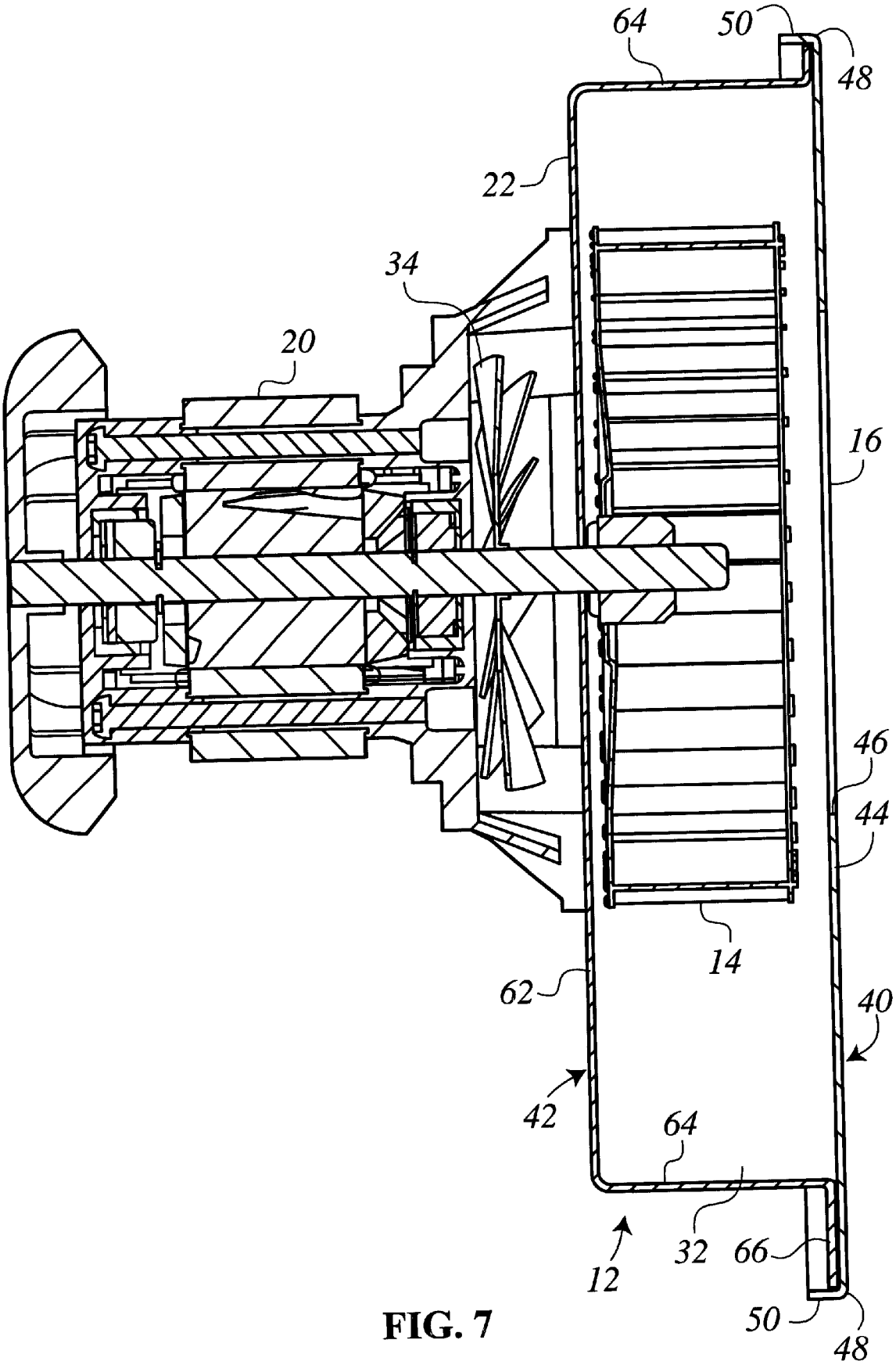
FIG. 7 is a section view taken along line 7—7 of FIG. 3.

As can best be seen in FIGS. 4 and 7, the entire blower housing 12 of the present invention is formed from two steel members that are affixed together by any appropriate means, such as gluing, stapling, welding, riveting, screwing, bolting, snap fit or other means. Specifically, the blower housing 12 is formed from the first housing member 40 and a second housing member 42 that are joined together to define the blower housing 12, including the open impeller cavity 32. The first housing member 40 includes a generally planar back plate 44 that includes a circular edge surface 46 to define the inlet opening 16. The back plate 44 extends to an outer edge 48 that includes an upstanding lip 50. The upstanding lip 50 is used to crimp the first housing member 40 to the second housing member 42, as will be described in greater detail below.

Referring now to FIG. 5, the back plate 44 of the second housing member 42 includes a plurality of mounting holes 51 positioned near its outer edge surface. The mounting holes 51 allow for flush mounting of the blower assembly 10 to a conventional furnace.

Referring now to FIG. 4, the first housing member 40 defines a wall portion 52 that extends away from the back plate 44 to define the transition between the impeller cavity 32 and a transition section 54 that eventually terminates with the exhaust outlet 18. The wall portion 52 defines the bottom half 55 of the transition section 54 and includes a flange 56 joined to an upstanding lip 58. The lip 58 is used to secure the first housing member 40 to the second housing member 42, as will be described in detail below.

As illustrated in FIG. 4, the flange 56 and lip 58 extend along the bottom half 55 of the transition section 54 until the flange 56 and lip 58 reach the exhaust outlet 18. The exhaust outlet 18 includes a seam 60 between the first housing member 40 and the second housing member 42. Referring now to FIG. 6, a similar flange 56 is formed on the opposite side of the transition section 54 to facilitate joining the two sections of the blower housing 12.

Referring now to FIG. 7, the second housing member 42 includes the generally planar mounting portion 62 that defines the top surface 22 of the blower housing 12. The mounting portion 62 is generally parallel to the back plate 44 of the first housing member 40 such that the space between the mounting portion 62 and the back plate 44 defines the impeller cavity 32. The second housing member 42 includes a circular outer wall 64 that is perpendicular to the mounting portion 62. The outer wall 64 terminates with a mounting flange 66 that extends outwardly from the circular outer wall 64. The mounting flange 66 is sized such that the second housing member 42 is received within the peripheral outer lip 50 formed on the first housing member 40.

Referring back to FIG. 4, the outer wall of the second housing member 42 is abbreviated in a portion of the second housing member 42 that defines the top half 68 of the transition section 54. Specifically, the outer wall 64 terminates with an expanded mounting flange 70 that is received upon the flange 56 of the first housing member 40. The flange 70 extends along the entire length of the top half 68 of the transition section 54 such that the first housing member 40 can be joined to the second housing member 42 along the transition section 54. Once again, the opposite side of the transition section 54 includes a similar flange 70.

Figure 3:
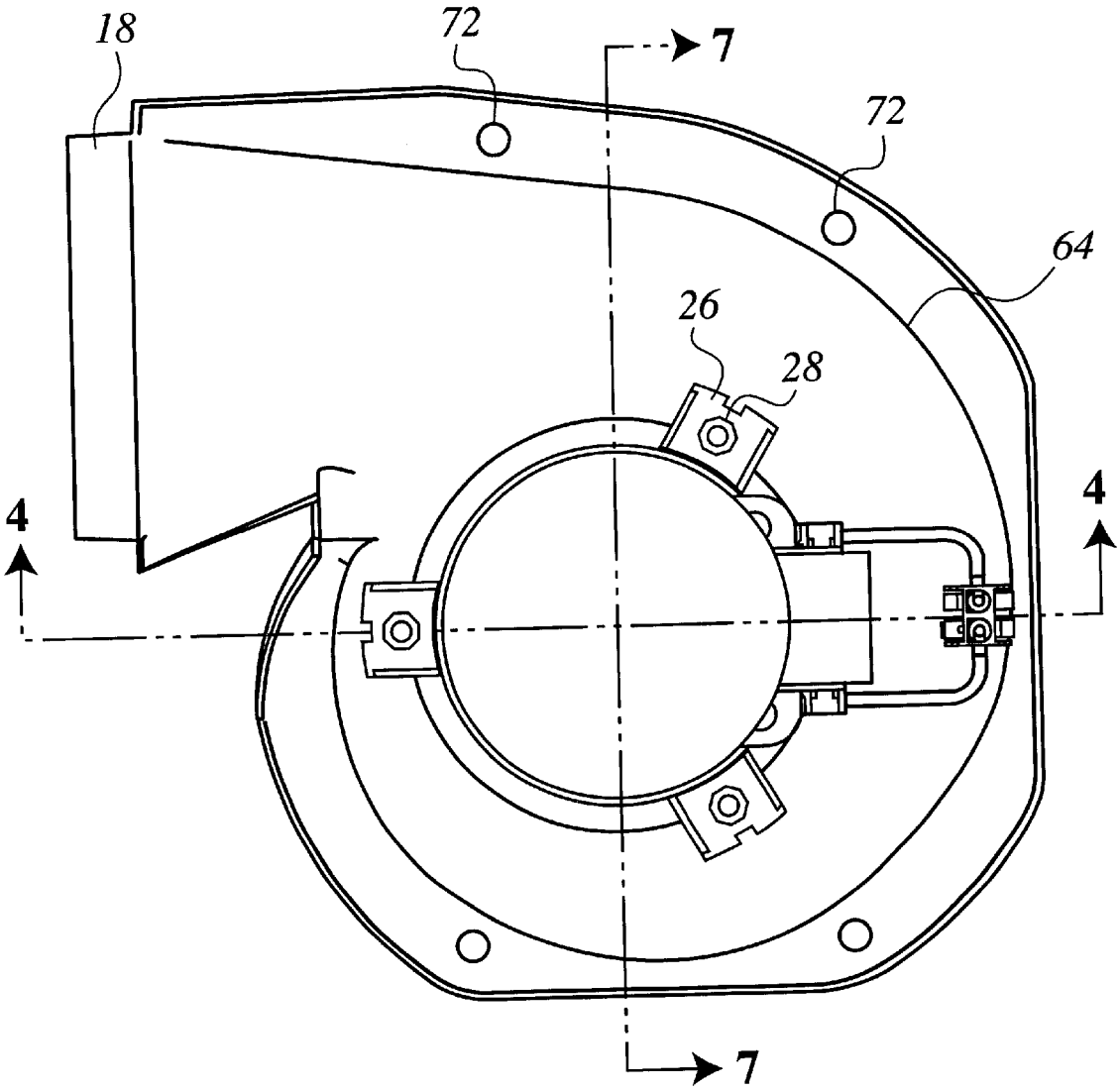
FIG. 3 is a top view of the blower housing and motor assembly.

Referring now to FIGS. 3 and 6, the second housing member 42 includes a plurality of spaced mounting holes 72 that are aligned with the mounting holes 51 formed in the first housing member 40. The aligned mounting holes allow the blower housing to be securely fixed to a surface of the furnace to which the blower housing 10 is installed.

Figure 2:
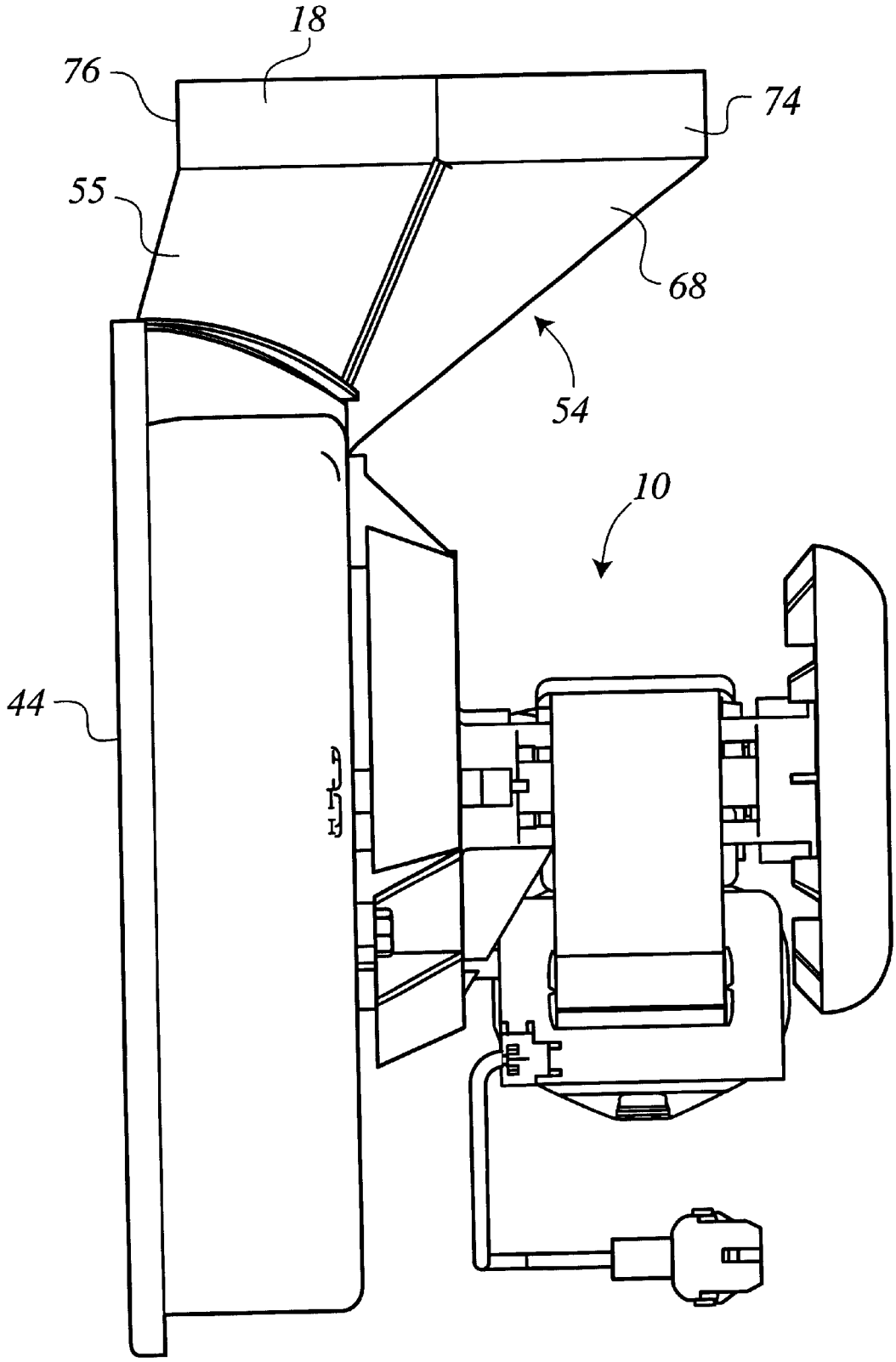
FIG. 2 is a side view of the blower housing of the present invention illustrating the offset of the circular exhaust outlet.

As can best be seen in FIG. 2, the bottom half 55 of the transition section 54 extends away from the generally planar back plate 44 of the first housing member 40. The bottom half 55 of the transition section 54 terminates with the circular outer edge 76 that defines the exhaust outlet 18. Likewise, the upper half 68 of the transition section 54, formed integrally with the second housing member 42, includes an outer edge 74 that combines with the outer edge 76 to form the circular exhaust outlet 18. The outer edge 76 is spaced away from the back plate 44 such that when the blower assembly 10 is installed on a furnace, the exhaust flue can be installed on the exhaust outlet 18.

Figure 1:
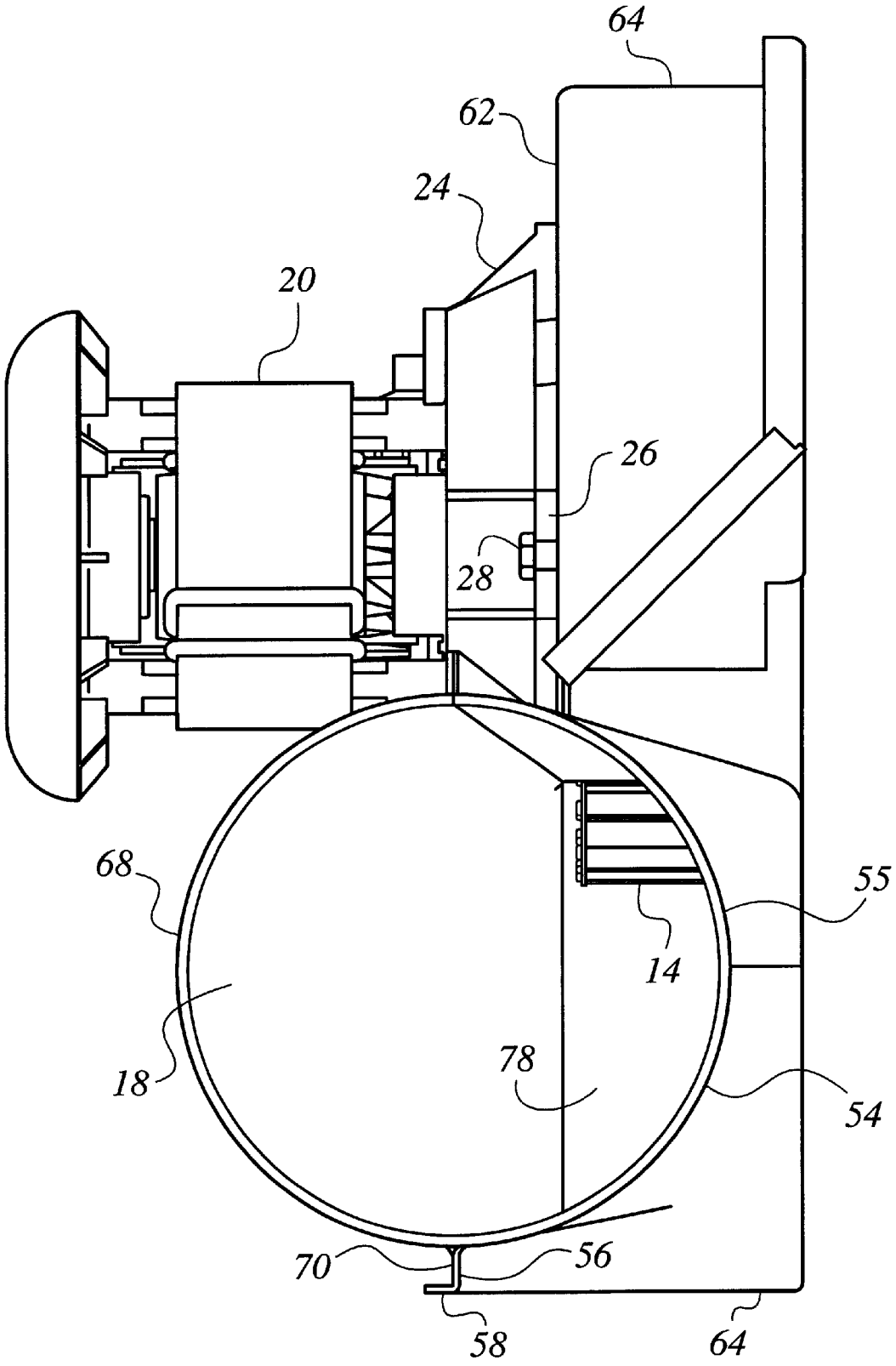
FIG. 1 is a front view of the blower housing of the present invention illustrating the circular exhaust outlet.

Referring back to FIG. 1, the transition section 54 provides a smooth, integrally formed transition between the rectangular outlet throat 78 from the internal impeller cavity 32 to the round, exhaust outlet 18. Specifically, the bottom half 55 of the transition section 54 is formed integrally with the first housing. member 40 and the top half 68 of the transition section 54 is formed integrally with the second housing member 42. Thus, the two-piece construction of the blower housing 12 of the present invention provides for the rectangular to circular transition section 54 and allows for flush mounting of the blower housing to a furnace.

Although there are many ways to manufacture the present invention and many materials from which the blower housing 12 can be formed, in the preferred embodiment of the invention, the blower housing 12 is formed from steel. The shape above the first housing member 40 and the second housing member 42 are created by either a stamping or a manual bending process. The most cost efficient method to produce high quality components for the blower housing 12 is through the process of stamping using dyes.

In one aspect of the present invention, steel is fed into the stamping machine in either the form of a sheet or a roll of continuous product. The stamping machine firmly grasps the edges of the steel sheet and presses the sheet to form either the first housing member or the second housing member. The mounting holes are formed in the housing member preferably through a punch method. Next, the housing member is trimmed around its outside edge. As can be understood in the previous figures, the lip 50 is then formed on the periphery of the first housing member 44.

The final step is a fixing the stamped first housing member to the stamped second housing member to form a finished blower housing. Preferably, the first and second housing members are affixed by crimping the lip of the first housing member to the mounting flange of the second housing member. However, other methods of attaching the two housing members are contemplated, such as welding, bolting, screwing, gluing, interlocking, riveting, clamping, and other reasonably effective methods of joining two metallic objects. After the blower housing has been formed, the motor assembly can then be attached to the top surface 22.

We claim:

1. A blower assembly for use in expelling exhaust gases from a furnace through a circular exhaust pipe comprising:

a blower motor having a motor shaft;

a blower housing formed from stamped metal and having an internal impeller cavity defined by an outer wall, an inlet opening, a circular exhaust outlet and a transition section, wherein the internal impeller cavity is in fluid communication with the circular exhaust outlet through the transition section, the transition section being formed as an integral part of the blower housing, the blower housing further comprising:

a first housing member formed from stamped metal defining a bottom half of both the transition section and the exhaust outlet of the blower housing; and a second housing member formed from stamped metal and attachable to the first housing member to define the transition section and the circular exhaust outlet, wherein the second housing member includes a top half of both the transition section and the exhaust outlet, wherein the motor shaft of the blower motor extends through a shaft opening formed in the second housing member;

a mounting flange for attaching the blower housing to the furnace, the mounting flange extending from the outer wall and being generally coplanar with the inlet opening; and an impeller mounted to the motor shaft and contained within the impeller cavity, wherein rotation of the impeller within the impeller cavity creates a flow of exhaust gases out of the circular exhaust outlet.

2. The blower assembly of claim 1 wherein the first housing member includes a first outer flange and the second housing member includes a second outer flange, wherein the first housing member and the second housing member are affixed to each other along the first outer flange and the second outer flange.

3. The blower assembly of claim 1 wherein the inlet opening is aligned with the impeller to allow exhaust gases to enter into the impeller cavity.

4. The blower assembly of claim 3 wherein the first housing member includes a generally planar back plate that includes the inlet opening and defines a first outer flange generally coplanar with the inlet opening.

5. The blower assembly of claim 4 wherein the circular exhaust outlet of the blower assembly is offset from the back plate of the first housing member.

6. The blower assembly of claim 1 wherein the first housing member and the second housing member are formed from stamped steel.

7. The blower assembly of claim 1 wherein the impeller cavity includes a rectangular outlet through which the flow of gases exits the impeller cavity, wherein the transition section of the blower housing extends between the rectangular outlet of the impeller cavity and the circular exhaust outlet.

8. The blower assembly of claim 1 wherein the bottom half of the transition section is joined to the top half of the transition section by crimping a first outer flange of a first housing member to a second outer flange of the second housing member.

9. A blower housing for a blower assembly including a blower motor coupled to an impeller for use in expelling exhaust gases from a furnace, the blower housing comprising:

an impeller cavity sized to receive the impeller, the impeller cavity having a generally rectangular outlet through which exhaust gases are expelled;

a transition section coupled to the rectangular outlet of the impeller cavity, the transition section being positioned to receive the expelled exhaust gases from the impeller cavity;

a circular exhaust outlet formed as a portion of the transition section, the circular exhaust outlet being configured to receive a circular exhaust pipe to expel exhaust gases away from the blower assembly;

a first housing member formed from stamped metal and configured to form a portion of the blower housing, the first housing member having an inlet opening to receive exhaust gases and a first outer flange, at least a portion of which is generally coplanar with the inlet opening, the first housing member defining a bottom half of both the transition section and the exhaust outlet; and a second housing member formed from stamped metal and having a second outer flange attachable to the first outer flange of the first housing member, the second housing member defining an upper half of both the transition section and the exhaust outlet, wherein the first housing member and the second housing member are joined to form the blower housing.

10. The blower housing of claim 9 wherein the first housing member and the second housing member are formed from stamped steel.

11. The blower housing of claim 9 wherein the first housing member includes a generally planar back plate having an inlet opening formed therein, wherein the inlet opening provides access into the impeller cavity such that exhaust gases can flow into the impeller cavity.

12. The blower housing of claim 11 wherein the exhaust outlet is offset from the back plate of the first housing member.

13. The blower housing of claim 9 wherein the blower housing is attachable to the furnace along the portion of the first outer flange that is generally coplanar with the inlet opening.

14. A blower assembly for use in expelling exhaust gases from a furnace through a circular exhaust pipe comprising:

a blower motor having a motor shaft;

a blower housing formed from stamped metal for supporting the blower motor, the blower housing comprising:

an internal impeller cavity defined by an outer wall;

an inlet opening positionable to receive exhaust gases from the furnace;

a mounting flange extending from the outer wall and being generally coplanar with the inlet opening;

a circular exhaust outlet configured to receive the circular exhaust pipe; and a transition section positioned between the circular exhaust outlet and the impeller cavity, wherein the internal impeller cavity is in fluid communication with the circular exhaust outlet through the transition section, the transition section being formed as an integral part of the blower housing;

an impeller mounted to the motor shaft and contained within the impeller cavity, wherein rotation of the impeller within the impeller cavity creates a flow of exhaust gases out of the circular exhaust outlet, wherein the blower housing is attachable to the furnace along the mounting flange.

15. The blower assembly of claim 14 wherein the blower housing further comprises:

a first housing member formed from stamped metal, the first housing member defining a bottom half of both the transition section and the exhaust outlet of the blower housing; and a second housing member formed from stamped metal, the second housing member being attachable to the first housing member to define the transition section and the circular exhaust outlet, wherein the second housing member includes a top half of both the transition section and the exhaust outlet, wherein the motor shaft of the blower motor extends through a shaft opening formed in the second housing member.

16. The blower assembly of claim 15 wherein the second housing member includes a second outer flange, wherein at least a portion of the second outer flange is generally coplanar with the inlet opening, wherein the first housing member includes a first outer flange such that the first housing member and the second housing member are affixed to each other along the first outer flange and the second outer flange to define the transition section and the exhaust outlet.

* * * * *